US010723598B2

(12) United States Patent
Stangl

(10) Patent No.: US 10,723,598 B2
(45) Date of Patent: Jul. 28, 2020

(54) CRANE

(71) Applicant: Liebherr-Werk Ehingen GmbH, Ehingen (DE)

(72) Inventor: Thomas Stangl, Allmendingen (DE)

(73) Assignee: LIEBHERR-WERK EHINGEN GMBH, Ehingen (DE)

( * ) Notice: Subject to any disclaimer, the term of this patent is extended or adjusted under 35 U.S.C. 154(b) by 0 days.

(21) Appl. No.: 15/699,538

(22) Filed: Sep. 8, 2017

(65) Prior Publication Data

US 2018/0072540 A1 Mar. 15, 2018

(30) Foreign Application Priority Data

Sep. 12, 2016 (DE) ..... 20 2016 005 619 U

(51) Int. Cl.
*B66C 23/82* (2006.01)
*B66C 23/66* (2006.01)
*B66C 23/60* (2006.01)

(52) U.S. Cl.
CPC ..... *B66C 23/823* (2013.01); *B66C 23/60* (2013.01); *B66C 23/66* (2013.01); *B66C 23/825* (2013.01); *B66C 23/826* (2013.01)

(58) Field of Classification Search
CPC ..... B66C 23/66; B66C 23/82; B66C 23/821; B66C 23/823; B66C 23/825; B66C 23/826
See application file for complete search history.

(56) References Cited

U.S. PATENT DOCUMENTS

| | | | | |
|---|---|---|---|---|
| 4,078,666 | A * | 3/1978 | Kather | B66C 23/52 212/262 |
| 4,982,853 | A | 1/1991 | Kishi | |
| 6,550,624 | B1 * | 4/2003 | Irsh | B66C 23/702 212/231 |
| 7,213,717 | B2 * | 5/2007 | Willim | B66C 23/701 212/299 |
| 7,270,243 | B2 * | 9/2007 | Diehl | B66C 23/82 212/270 |
| 7,293,669 | B2 | 11/2007 | Paschke | |
| 2011/0132860 | A1 * | 6/2011 | Bohnacker | B66C 23/82 212/262 |
| 2011/0240582 | A1 * | 10/2011 | Streitz | B66C 23/702 212/293 |
| 2011/0272377 | A1 * | 11/2011 | Willim | B66C 13/06 212/285 |
| 2015/0203337 | A1 * | 7/2015 | Roodenburg | B63B 27/10 212/309 |

FOREIGN PATENT DOCUMENTS

| | | | |
|---|---|---|---|
| DE | 1751383 | U | 8/1957 |
| DE | 3105771 | A1 | 9/1982 |
| DE | 10315989 | A1 | 11/2004 |
| DE | 102007058553 | A1 | 6/2009 |

* cited by examiner

*Primary Examiner* — Sang K Kim
*Assistant Examiner* — Nathaniel L Adams
(74) *Attorney, Agent, or Firm* — McCoy Russell LLP

(57) ABSTRACT

The invention relates to a crane, in particular to a mobile crane, comprising a lattice boom, a derrick boom, and a boom guying led from the derrick boom to the boom tip, wherein at least one guying frame is provided that is fastened to the boom between the derrick boom and the boom tip and is connected to the boom guying.

18 Claims, 6 Drawing Sheets

CRANE

CROSS REFERENCE TO RELATED APPLICATIONS

This application claims priority to German Utility Model Application No. 20 2016 005 619.1, entitled "CRANE," filed Sep. 12, 2016, the entire contents of which is hereby incorporated by reference in its entirety for all purposes.

TECHNICAL FIELD

The invention relates to a crane, in particular to a mobile crane, comprising a lattice boom, a derrick boom, and a boom guying led from the derrick boom to the boom tip, wherein at least one guying frame is provided that is fastened to the boom between the derrick boom and the boom tip and is connected to the boom guying.

BACKGROUND

It is sufficiently known to guy lattice booms in crane operation. The guying used as a rule runs over the boom back, with the guying being connected to the crane or to the boom at the respective end regions. To limit the deflection of booms on erection and during crane operation, it is already known to insert an additional guying device between the connection points of the guying, for example in the form of a further guying support over which the guying runs. Due to the angling of the guying caused by this, if the guying is loaded, an upwardly directed tensile force results in the additional guying device. This tensile force pulls the boom upward and thereby limits the total deflection of the boom system. The additional guying device has typically been designed as a rope construction or as light steel construction.

A schematic drawing of such a boom system using a lattice boom is shown in FIG. 1A A boom 1 is guyed by means of a guying 2. An additional guying support 3 that is installed in the central region of the boom 1 transmits a tensile stress applied by the guying 2 onto the boom 1 so that its deflection is limited in the region of the additional guying support 3. FIG. 1B illustrates the deflection of the boom without any additional guying support while FIG. 1C illustrates the deflection of the boom 1 limited by the guying support 3. The hatched lines 5, 6 show the possible deflection of the boom 1 during the erection or operation of the crane.

In the meantime, cranes or crane booms have become longer and longer in dimension, which results in greater deformations of the boom system in crane operation. An increasing problem here is the lateral deformation of the boom system by engaging transverse forces, e.g. by wind, slanted position, imperfections. FIG. 2 shows a rear view of the crane shows an example. The boom 1 is laterally deformed by the engaging transverse force FQ. The lateral deformation is additionally increased by attaching the load 100 to the lifting hook 101. The 2nd order theory plays a role here, i.e. the equilibrium at the deformed system is looked at. Forces that had no influence on the non-deformed system now have an influence. The boom 1 experiences displacement from its ideal alignment in the luffing plane 103 due to a slanted position $\alpha$ or due to a transverse load 102 such as wind. The guying 20 introduces a holding force into the boom 1; in addition, in accordance with the representation in FIG. 2, it introduces a further transverse force FQ, Absp. into the boom 1, which additionally increases the lateral deformation of the boom 1.

Bending moments furthermore occur at the boom system in crane operation, in particular with a slanted version of boom 1 and with an attached load. This is shown, for example, in FIG. 3A and FIG. 3B that show a crane configuration having a fixed tip (FIG. 3A) and having a luffable tip (FIG. 3B). A guying 2 extending from the derrick boom 4 to the boom tip simultaneously serves as a luffing drive of the boom 1. The behavior is comparable for both crane configurations. During crane operation with a slanted version of boom 1, high bending moments MB occur to the rear or upwardly in the region of the boom tip or of the upper part of the boom 1, which is indicated by the hatched surface. Conventional additional stay poles cannot counteract this bending moment since only a tensile force can be introduced by them into the boom system, i.e. the bending moment is theoretically further increased. For this reason, the additional guying support 3 are frequently only used during erection.

The object of the present invention comprises providing an improved guying of a boom that in particular makes larger payloads possible in crane operation.

SUMMARY

In accordance with the invention, a crane is equipped with a lattice boom, a derrick boom, and a boom guying led from the derrick boom toward the boom tip. The derrick boom is preferably a fixed-position derrick boom. The boom guying is furthermore connected to at least one guying frame and extends from the derrick boom over the guying frame to the boom tip. A derrick boom stands in a predefined position in crane operation. On the luffing of the main boom, the rope arrangement of the adjustment block of the derrick boom is retracted or let out. The geometrical relationships between the derrick boom, the boom guying, the guying frame, and the main boom thereby change.

The guying frame used is configured in accordance with the invention such that a compressive force and/or transverse force can be transmitted from the guying to the boom in crane operation. Previous additional guying devices only served the transmission of a tensile stress to prevent a middle downward deflection of the boom in a targeted manner. The use of a suitable construction of the boom guying frame with a lattice boom guyed by means of a derrick boom now effects a transmission of a compressive force and/or transverse force from the guying over the guying frame into the lattice boom, preferably with a slanted boom position. The compressive force counteracts the bending moments arising during crane operation, whereby a deflection of the boom in the direction of the boom back is reduced. The applied transverse force prevents any lateral deformation of the boom. The guying should in particular thereby be held over the boom. It is ensured by the at least one guying frame that the guying runs along the rear side of the boom and, unlike in FIG. 2, only differs slightly laterally from the boom back. The transverse forces introduced by the guying onto the boom system can thereby be reduced and the deformation of the boom system due to transverse forces can be decreased.

A design of the guying frame with at least two mutually connected side elements or side plates is particularly preferred. The design of the guying frame in a spatial lattice construction, ideally with a rectangular cross-section, is further advantageous. A stable construction of the guying frame provides the required compressive stiffness and/or transverse stiffness for transmitting the compressive forces and/or transverse forces from the guying into the boom system. The guying frame can additionally consist of or at least comprise a fiber composite material.

Provision can be made that the at least one guying frame is supported at the lattice boom pivotable about a pivot axis perpendicular to the longitudinal boom axis. Constructions of the guying frame that permit a folding capability or a spreadability of the guying frame are likewise advantageous. The latter can preferably be folded onto the boom system for the crane transport due to the folding capability. Provision can, for example, be made that the guying frame is configured to achieve a spreading of the guying, i.e. at least two guying strands run over the guying frame. The angle of the corresponding guying frame for spreading the guying can, for example, be variable in an advantageous embodiment.

There is equally the possibility of fixedly supporting the guying frame at the lattice boom.

The same applies in another respect to the guying that can be supported either movably or fixedly at the guying frame. There is equally the possibility of guiding a guying, in particular a guying rope arrangement, over the guying frame.

The arrangement of the at least one guying frame in the middle boom region, i.e. centrally between the derrick boom and the boom tip, is preferred. On the use of a plurality of guying frames, they can be supported at the boom system distributed over the longitudinal boom axis.

With the crane in accordance with the invention, the guying further preferably serves as a luffing drive of the boom, i.e. the boom system can be correspondingly luffed up or down by actuating the guying, for example by means of a guying winch. The actuation of the guying can equally take place by means of an adjustment block that connects the guying to the derrick boom.

A rectangular or V-shaped or trapezoidal embodiment of the guying frame is furthermore conceivable. The corresponding shape of the guying frame is dependent on the application and in particular serves to spread the guying.

In accordance with the invention, the guying frame is suitable to introduce compressive forces and/or transverse forces to the boom system. It is, however, likewise conceivable that the construction of the guying frame is likewise suitable for taking up the tensile forces acting on the boom system.

The length of the at least one guying frame is preferably adjustable, whereby the lateral spacing of the guying rope arrangement from the boom is adjustable. The frame length is ideally variable during crane operation.

Further advantages and properties of the invention will be explained in more detail in the following with reference to an embodiment shown in the drawings.

DETAILED DESCRIPTION

To reduce the lateral deformation of the boom system decreasing the payload and to reduce the influence of load-induced bending moments, an additional guying frame system has been developed that, unlike previous additional guying systems, can also take up compressive forces and transverse forces. The previous additional guying devices could not do this.

Figure 4:
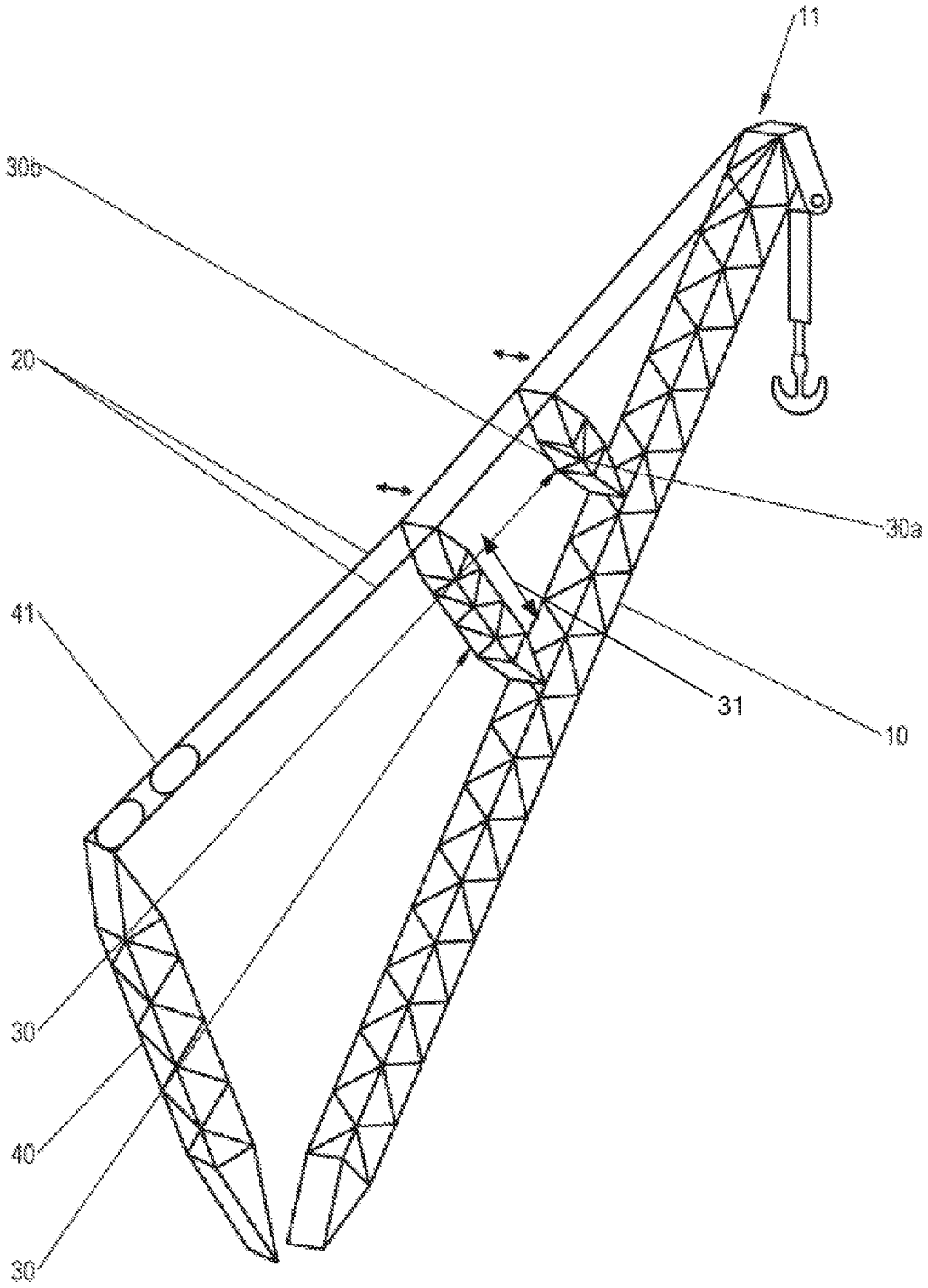
FIG. 4 shows a representation of the boom system of the crane in accordance with the invention.

FIG. 4 shows an embodiment of the invention. The newly developed guying frames 30, with an adjustable length 31, comprise two side plates that are connected to one another. The guying frames are constructed in a spatial lattice construction so that they are suitable for taking up compressive forces and lateral forces. The arrangement of the one or both lattice frames 30 is disposed in this respect in the middle third of the boom 10, i.e. the remaining length of the boom 10 after the topmost guying frame 30 up to the boom tip 11 amounts to approximately a third of the total main boom length. A guying 20, preferably a double-strand guying, is guided from the derrick boom 40 over the guying frames 30 up to the boom tip 11 and is lashed thereto. The guying 20 can be composed of individual stay poles. The use of a rope arrangement is likewise possible, however. In the crane looked at, the boom guying 20 simultaneously represents the luffing drive that is implemented by an adjustment block 41 at the derrick boom 4 over the stay poles 20.

The derrick boom 40 is in a predefined position in crane operation. On the luffing of the main boom 10, the rope arrangement of the adjustment block 41 of the derrick boom 40 is retracted or let out. The geometrical relationships between the derrick boom 40, the boom guying 20, the guying frame 30, and the boom 10 hereby change.

The connection of the guying frames 30 to the boom 10 is designed as pivotable about a pivot axis perpendicular to the longitudinal boom axis. Alternatively, the guying frames 30 can, however, also be fixedly connected to the boom system.

Figure 1A:
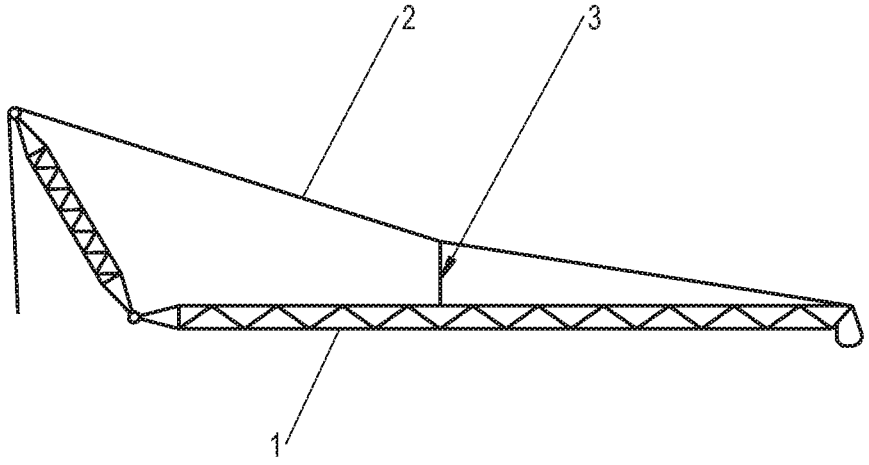
Fig. 1a PRIOR ART
FIGS. 1A, 1B, 1C show a boom system in accordance with the prior art and schematic diagrams to explain the previous operation.
Figure 1B:
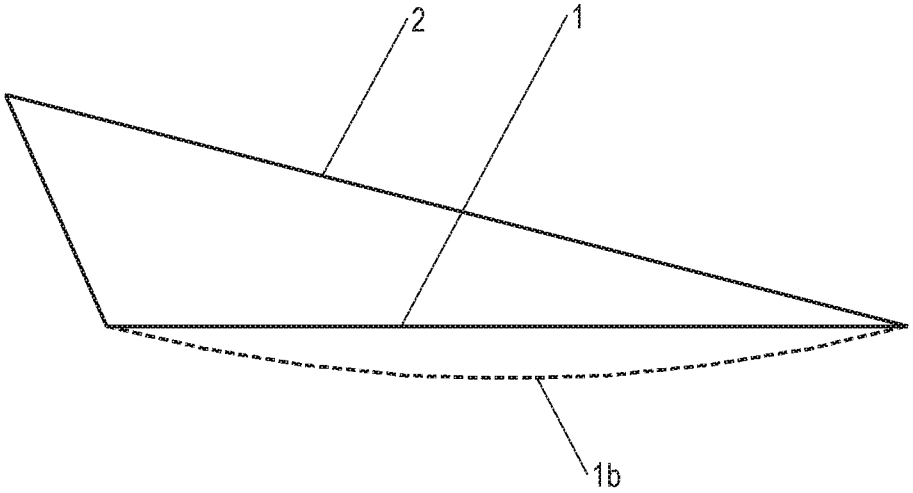
Fig. 1b PRIOR ART
Figure 1C:
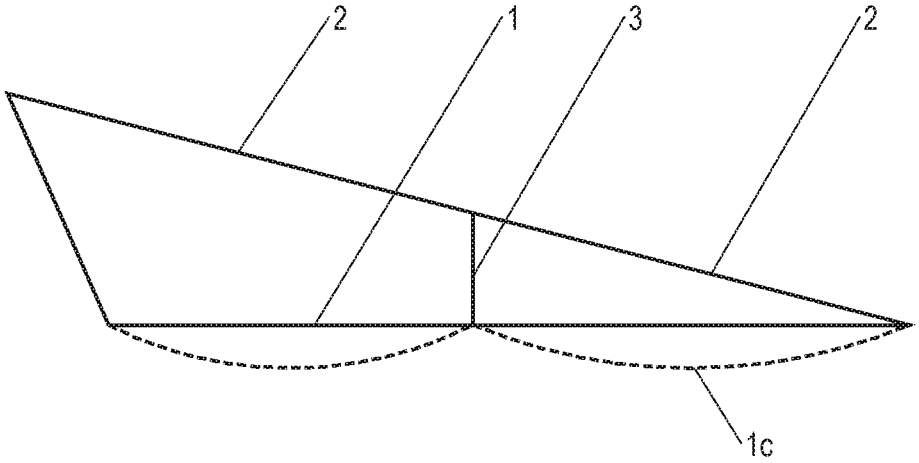
Fig. 1c PRIOR ART
Figure 2:
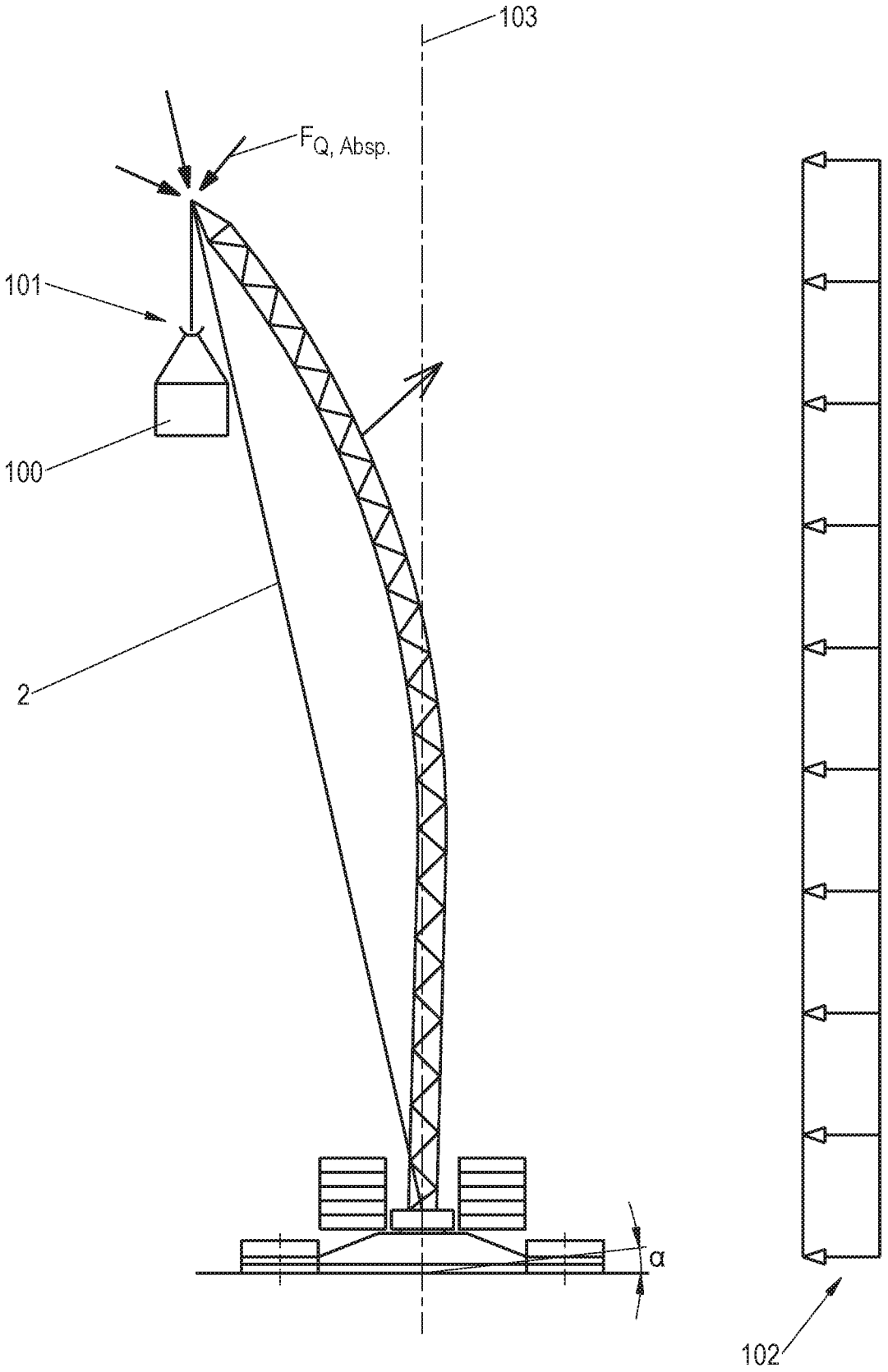
Fig. 2 PRIOR ART
FIG. 2 shows a schematic diagram to illustrate transverse forces on the boom.
Figure 5:
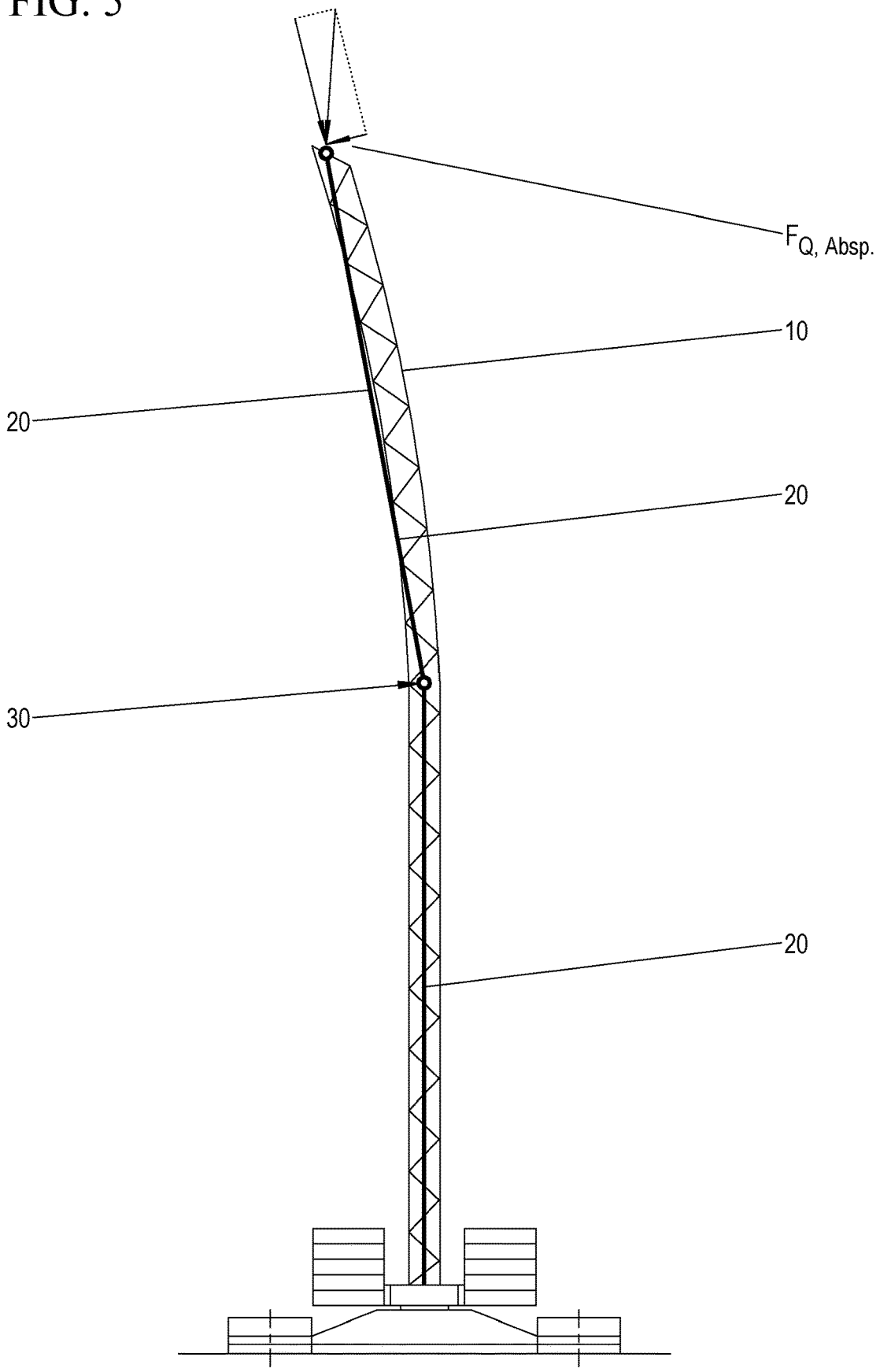
FIG. 5 shows a schematic diagram of the crane to represent the mode of action.

It is important for the design of the guying 20 that the guying frame or frames 30 hold the guying 20 above the boom 10 wherever possible. This is shown, for example, in FIG. 5 that shows a rear view of the crane system in accordance with the invention. It is ensured due to the guying frame 30 that the guying 20 runs along the rear side of the boom 10 and, unlike in FIG. 2, only differs slightly laterally from the boom back. The transverse forces $F_Q$ introduced by the guying onto the boom system can thereby be reduced and the deformation of the boom system due to transverse forces can be decreased. The stiff side plates 30*a*, 30*b* of the guying frame 30 are only very slightly deformed due to the transverse forces.

Figure 6:
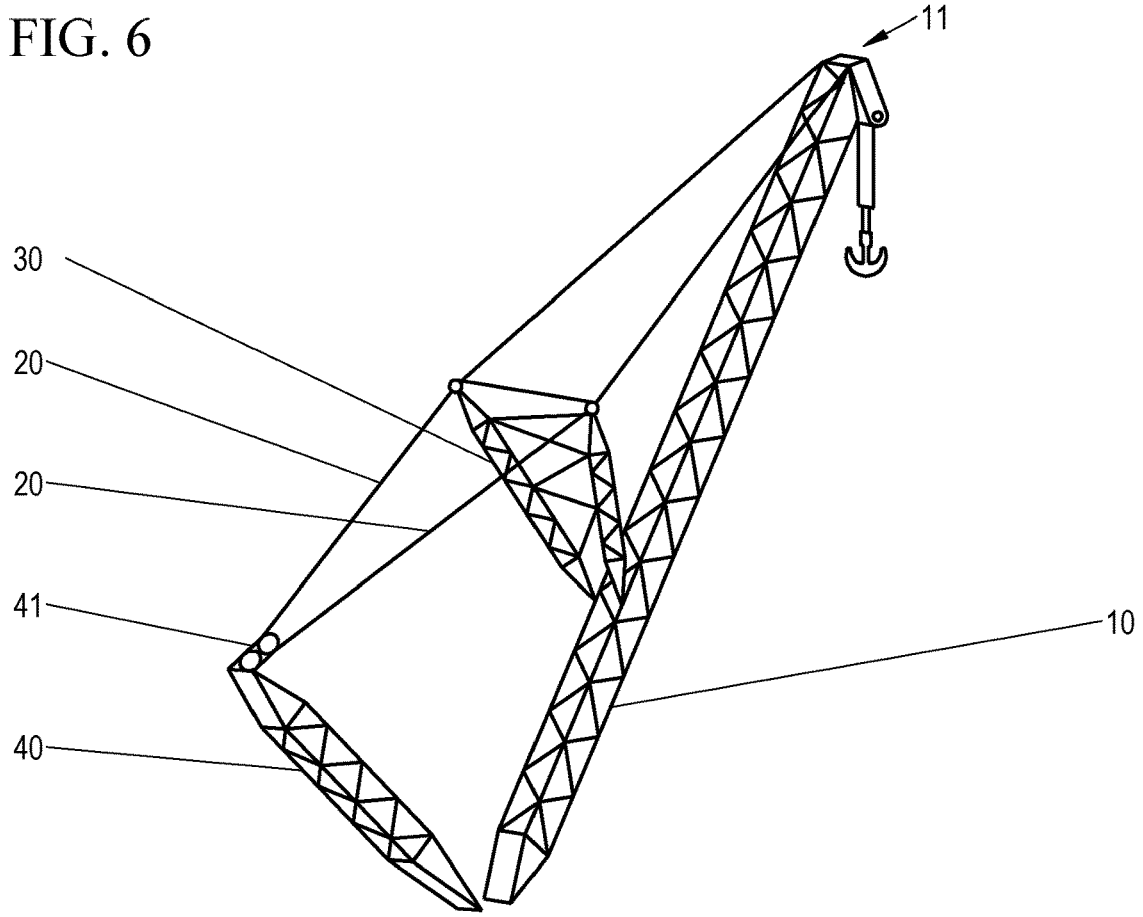
FIG. 6 shows an alternative embodiment of the guying frame for the crane in accordance with the invention.

In order to additionally increase the effect of the guying frame 30, the latter can also be of V-shaped or trapezoidal construction, as can be seen, for example, from FIG. 6. The spreading of the boom guying 20 is increased by the trapezoidal construction of the guying frame 30 of FIG. 6, which additionally increases its effect.

A further profitable application of the guying frame 30 in accordance with the invention comprises the latter likewise reducing the bending moment MB acting on the boom systemduring the crane work due to its construction stiff with respect to compression. This applies all the more to steep boom positions.

Figure 3A:
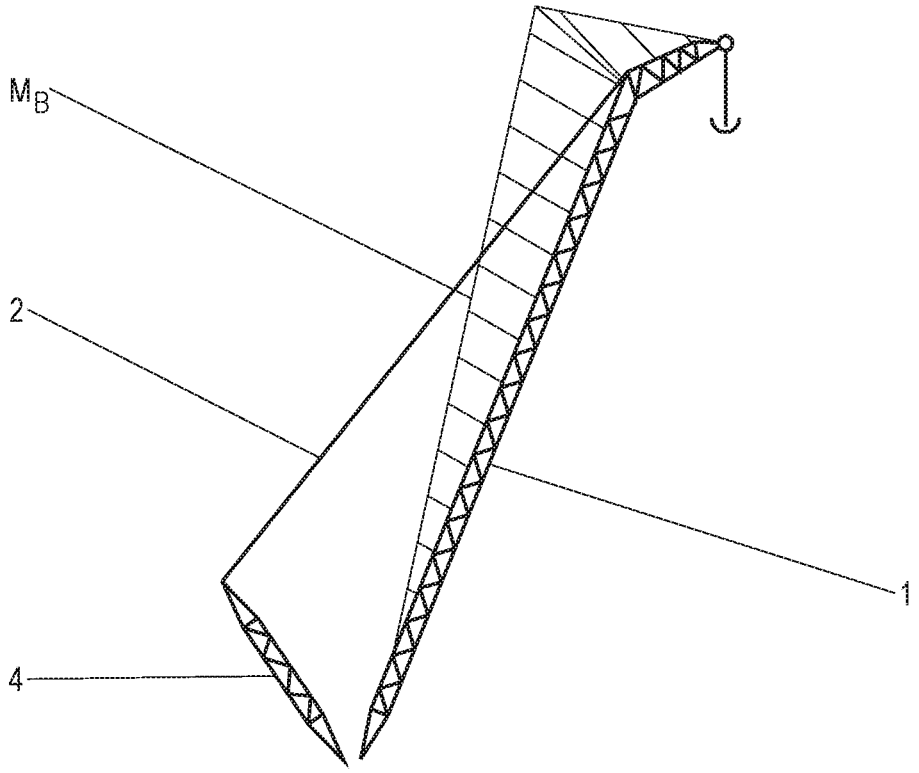
Fig. 3a PRIOR ART
FIGS. 3A, 3B show schematic diagrams to illustrate bending moments acting on a conventional boom system.
Figure 3B:
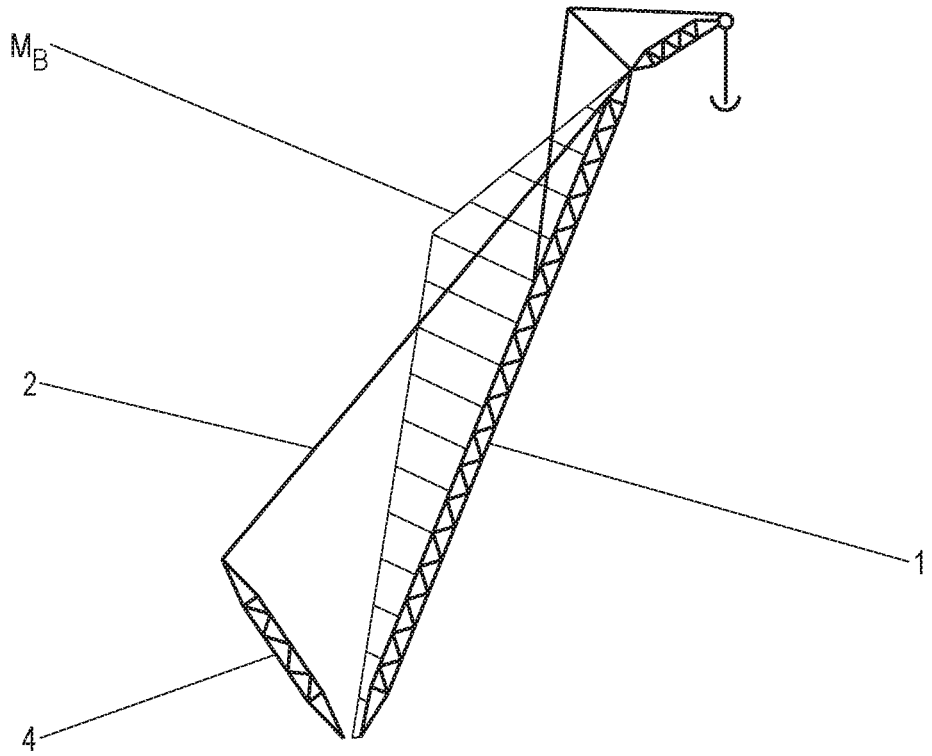
Fig. 3b PRIOR ART
Figure 7A:
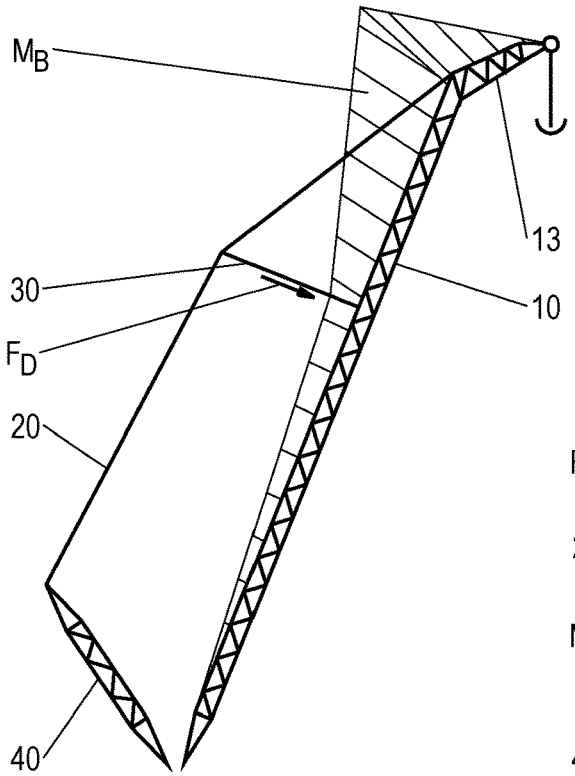
FIGS. 7A, 7B show schematic diagrams to further illustrate the operation of the crane in accordance with the invention.
Figure 7B:
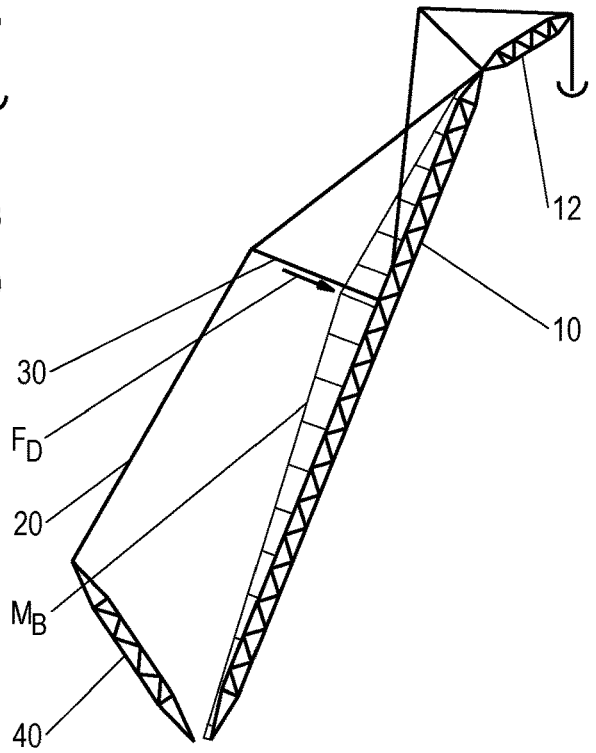

As can be seen from FIGS. 7A and 7B, the guying 20 here runs from the derrick boom 40 to the boom tip of the boom 10. The boom 10 shown is additionally designed with a fixed lattice tip 13. The guying frame 30 in accordance with the invention is also arranged after approximately two thirds of the main boom length here. As is shown by the arrow direction, a compressive force FD is introduced into the boom 10 by the guying 20, said compressive force counteracting the bending moment MB in the region of the guying frame 30 and considerably reducing the boom deformation. A comparison of FIGS. 3A and 7A show the positive effect.

The same result is furthermore produced in a crane to whose main boom 10 a luffable lattice tip 12 or an additional boom connected in an articulated manner is fastened. Bending moments MB occurring in the region of the guying frame 30 can also be substantially compensated here by the introduction of a compressive force FD over the guying frame 30.

The essential inventive features of the guying 20 in accordance with the invention or of the guying frame 30 will again be given in the following. The guying frame 30 can likewise take up both tensile forces and lateral forces in addition to compressive forces. This is achieved, for example, by a rectangular or trapezoidal or V-shaped construction of the guying frame 30 that is set up as a spatial guying frame from a lattice structure. The boom system can be equipped with a single guying frame 30 or with a plurality of frames 30 arranged behind one another. The guying frames can furthermore be designed as foldable to vary their angles with respect to the boom 10. An adaptation of the spreading can also be possible in the spatial design of the guying frame 30 to be able to set the resulting spread of the guying 20.

The invention claimed is:

1. A crane comprising a lattice boom, a derrick boom, and a boom guying guided from the derrick boom to a boom tip of the lattice boom, wherein at least one boom guying frame is fastened to the lattice boom between the derrick boom and the boom tip and is connected to the boom guying;

wherein the at least one boom guying frame has a spatial lattice structure and comprises at least two side elements connected to one another along a length of the at least one boom guying frame, and each strand of the boom guying extending from the derrick boom to one of the at least two side elements and then to the boom tip, where the at least one boom guying frame transmits compressive forces and transverse forces to apply the compressive forces and the transverse forces to the lattice boom over the boom guying during crane operation; and wherein the boom guying is a luffing drive that operates the lattice boom.

2. The crane in accordance with claim 1, wherein the boom guying comprises two strands and each strand extends from the derrick boom to one of the at least two side elements of the boom guying frame, then to one of at least two side elements of a second boom guying frame, and then to the boom tip.

3. The crane in accordance with claim 1, wherein the spatial lattice structure is constructed from fiber composite materials and extends along the length of the at least one boom guying frame and across the at least two side elements.

4. The crane in accordance with claim 1, wherein the at least one boom guying frame is designed as rectangular or V-shaped or trapezoidal.

5. The crane of claim 4, wherein the at least one boom guying frame spreads the boom guying.

6. The crane in accordance with claim 1, wherein the at least one boom guying frame is supported at the lattice boom pivotable about a pivot axis perpendicular to a longitudinal boom axis or is fixedly connected to the lattice boom.

7. The crane in accordance with claim 1, wherein the boom guying is supported or guided movably at the at least one boom guying frame.

8. The crane in accordance with claim 1, wherein the at least one boom guying frame is attached in a middle boom region.

9. The crane in accordance with claim 1, wherein exactly one boom guying frame is arranged at the lattice boom so that a remaining main boom length from a topmost boom guying frame up to the boom tip amounts to approximately a third of a total main boom length and the lattice boom is comprised of a single boom section.

10. The crane in accordance with claim 1, wherein the at least one boom guying frame is suitable to take up tensile forces acting on the lattice boom and the derrick boom.

11. The crane in accordance with claim 1, wherein the length of the at least one boom guying frame is adjustable during or outside of crane operation.

12. The crane of claim 1, wherein the at least one boom guying frame transmits compressive forces to the lattice boom over the boom guying during crane operation.

13. The crane of claim 1, wherein construction of the at least one boom guying frame transmits transverse forces to the lattice boom over the boom guying during crane operation.

14. The crane in accordance with claim 1, wherein the boom guying is rigidly connected to the at least one boom guying frame.

15. The crane in accordance with claim 1, wherein a plurality of frames are arranged behind one another so that a remaining main boom length from a topmost boom guying frame up to the boom tip amounts to approximately a third of a total main boom length.

16. The crane in accordance with claim 1, wherein the length of the at least one boom guying frame is adjustable during crane operation.

17. The crane in accordance with claim 1, wherein each strand of the boom guying is connected to an adjustment block positioned between the derrick boom and the at least one boom guying frame.

18. A crane comprising a lattice boom, a derrick boom, and a boom guying guided from the derrick boom to a boom tip of the lattice boom, wherein at least one boom guying frame is fastened to the lattice boom between the derrick boom and the boom tip and is connected to the boom guying;

wherein the at least one boom guying frame has a spatial lattice structure and comprises at least two side elements connected to one another along a length of the at least one boom guying frame, and each strand of the boom guying extending from the derrick boom to one of the at least two side elements and then to the boom tip, and each strand of the boom guying is connected to an adjustment block positioned between the derrick boom and the at least one boom guying frame, where the at least one boom guying frame transmits compressive forces and/or transverse forces to apply the compressive forces and/or the transverse forces to the lattice boom over the boom guying during crane operation; and wherein the boom guying is a luffing drive that operates the lattice boom.

* * * * *